US009020176B2

(12) United States Patent
Burns

(10) Patent No.: US 9,020,176 B2
(45) Date of Patent: Apr. 28, 2015

(54) APPARATUS FOR VENTED HEARING ASSISTANCE SYSTEMS

(75) Inventor: Thomas Howard Burns, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1035 days.

(21) Appl. No.: 12/051,635

(22) Filed: Mar. 19, 2008

(65) Prior Publication Data

US 2008/0232621 A1 Sep. 25, 2008

Related U.S. Application Data

(60) Provisional application No. 60/895,679, filed on Mar. 19, 2007.

(51) Int. Cl.
*H04R 25/00* (2006.01)

(52) U.S. Cl.
CPC ..... *H04R 25/652* (2013.01); *H04R 25/456* (2013.01); *H04R 25/658* (2013.01); *H04R 2225/021* (2013.01); *H04R 2225/025* (2013.01); *H04R 2460/11* (2013.01); *H04R 25/656* (2013.01); *H04R 2225/77* (2013.01)

(58) Field of Classification Search
USPC ..... 381/154, 328, 331, 312–322; 358/474; 179/107
See application file for complete search history.

(56) References Cited

U.S. PATENT DOCUMENTS

| | | | | |
|---|---|---|---|---|
| 3,946,168 | A * | 3/1976 | Preves | 381/313 |
| 4,677,675 | A | 6/1987 | Killion | |
| 4,852,177 | A * | 7/1989 | Ambrose | 381/338 |
| 5,068,902 | A | 11/1991 | Ward | |
| 5,195,139 | A * | 3/1993 | Gauthier | 381/322 |
| 6,661,901 | B1 * | 12/2003 | Svean et al. | 381/328 |
| 6,766,031 | B1 * | 7/2004 | Westermann | 381/328 |
| 8,229,127 | B2 * | 7/2012 | Jorgensen et al. | 381/71.6 |
| 2003/0002089 | A1 * | 1/2003 | Vadnais et al. | 358/474 |
| 2003/0059075 | A1 * | 3/2003 | Niederdrank | 381/328 |
| 2004/0052391 | A1 * | 3/2004 | Bren et al. | 381/331 |

(Continued)

FOREIGN PATENT DOCUMENTS

| | | | |
|---|---|---|---|
| CH | 681125 | A5 | 1/1993 |
| DE | 4010372 | A1 | 10/1991 |

(Continued)

OTHER PUBLICATIONS

Macrae, John, "A new kind of earmold vent—the high-cut cavity vent", Hearing Instruments, vol. 32 No. 10, (1981), pp. 18 and 64.
Rafaeley, B., et al., "Feedback Path Variability Modeling for Robust Hearing Aids", Acoust. Soc. Am ., vol. 105, No. 5, Pt. 1, (May 2000).
"European Application Serial No. 08250914.2,Extended European Search Report mailed Mar. 8, 2011", 10 Pgs.

(Continued)

*Primary Examiner* — Eugene Lee
*Assistant Examiner* — Fang-Xing Jiang
(74) *Attorney, Agent, or Firm* — Schwegman Lundberg & Woessner, P.A.

(57) ABSTRACT

An apparatus related to earmolds with venting configurations designed to relieve the occlusion effect. Various designs provide multiple vents allow residual ear canal air volume to vent to and from air outside the ear and the earmold. In various designs, the earmold includes one vent between the residual ear canal air volume and a volume of air internal to the earmold. A second vent provides passage of air internal to the earmold and air external to the ear and the inserted earmold when worn by a user.

24 Claims, 11 Drawing Sheets

(56) References Cited

U.S. PATENT DOCUMENTS

| | | | | |
|---|---|---|---|---|
| 2007/0127755 | A1* | 6/2007 | Bauman | 381/328 |
| 2007/0206826 | A1* | 9/2007 | Rohrlein | 381/325 |

FOREIGN PATENT DOCUMENTS

| | | | |
|---|---|---|---|
| EP | 1246505 | A1 | 10/2002 |
| WO | WO-92/21218 | A1 | 11/1992 |
| WO | WO-98/47318 | A1 | 10/1998 |

OTHER PUBLICATIONS

Bavosi, R P, et al., "Venting without feedback—further development of the high-cut cavity vent", vol. 33, No. 4 (Jan. 1, 1982), 12-15.

European Application Serial No. 08250914.2, Office Action mailed Oct. 16, 2012, 8 pgs.

European Application Serial No. 08250914.2, Response filed Feb. 26, 2013 to Examination Notification Art. 94(3) mailed Oct. 16, 2012, 8 pgs.

* cited by examiner

APPARATUS FOR VENTED HEARING ASSISTANCE SYSTEMS

RELATED APPLICATION

This application claims the benefit of U.S. Provisional Patent Application Ser. No. 60/895,679 filed Mar. 19, 2007, which is incorporated herein by reference and made a part hereof.

FIELD

This application relates generally to hearing assistance systems and in particular to method and apparatus for venting hearing assistance systems.

BACKGROUND

For moderate and high-loss hearing aid users with vented earmolds, vent dimensions are typically chosen to provide an acceptable balance between acoustic feedback and the occlusion effect. Acoustic feedback occurs when amplified sound propagates from the ear canal, outward through the vent, and into the hearing aid microphone inlet thereby causing an audible and annoying whistle to the user. In general, this acoustic feedback whistling occurs at higher frequencies, typically above 1 kHz. The occlusion effect can be described as an unnatural perception of one's own voice, and occurs when a hearing aid user's earmold is insufficiently occluded thereby causing an accentuation of low-frequency speech energy in the ear canal that is typically perceived as a boominess. Although a wider, more open vent has been successful in prior art in providing the user with a more natural perception of their own voice, such a venting scheme makes the hearing aid more susceptible to acoustic feedback.

Thus, there is a need in the art for a venting scheme that allows the low-frequency speech energy to escape the ear canal more readily and attenuates acoustic feedback at higher frequencies. Compared to a single vent, dual vents configured as an acoustic filter address both these goals more robustly.

SUMMARY

The above-mentioned problems and others not expressly discussed herein are addressed by the present subject matter and will be understood by reading and studying this specification.

The present subject matter presents apparatus related to earmolds with venting configurations designed to relieve the occlusion effect. In various embodiments, multiple vents allow residual ear canal air volume to vent to and from air outside the ear and the earmold. In various embodiments, the earmold includes one vent between the residual ear canal air volume and a volume of air internal to the earmold. A second vent provides passage of air internal to the earmold and air external to the ear and the inserted earmold when properly worn by a user. According to various embodiments, an acoustical passage of the first vent and an acoustical passage of the second vent are elongate. The first and second vents are not in geometric alignment, or off-axis, in various embodiments. Various earmold embodiments include circular earmold openings for the vents. Various embodiments include noncircular earmold openings for the vents. Various embodiments include a wireless receiver in the earmold. Various embodiments include a sound tube between the earmold and a behind-the-ear hearing assistance device. Various embodiments include a receiver in the earmold wired to a behind-the-ear hearing assistance device. Various embodiments include hearing assistance electronics disposed within the earmold and vent openings in the earmold positioned to reduce acoustical feedback.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and therefore not exhaustive, and the scope of the present subject matter is defined by the appended claims and their legal equivalents.

Figure 1A:
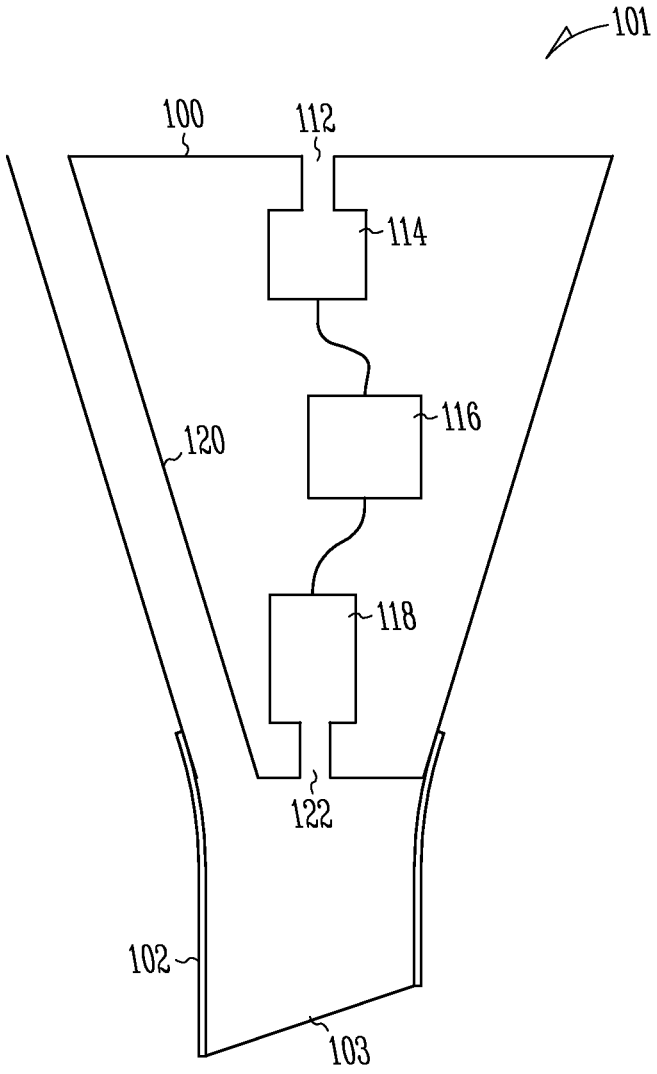
Fig. 1A (Prior Art)
FIG. 1A shows a side cross-sectional view of an in-the-ear hearing assistance device according to the prior art earmold venting.
Figure 1B:
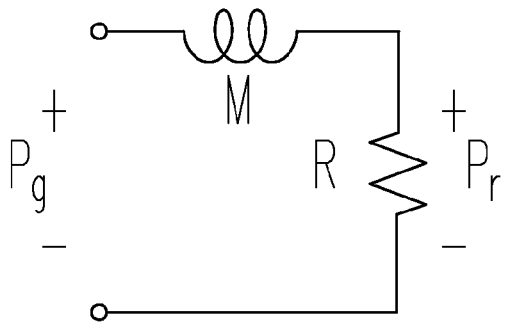
Fig. 1B (Prior Art)
FIG. 1B shows an acoustical impedance lumped element equivalent circuit analog for the device shown in FIG. 1A.
Figure 1C:
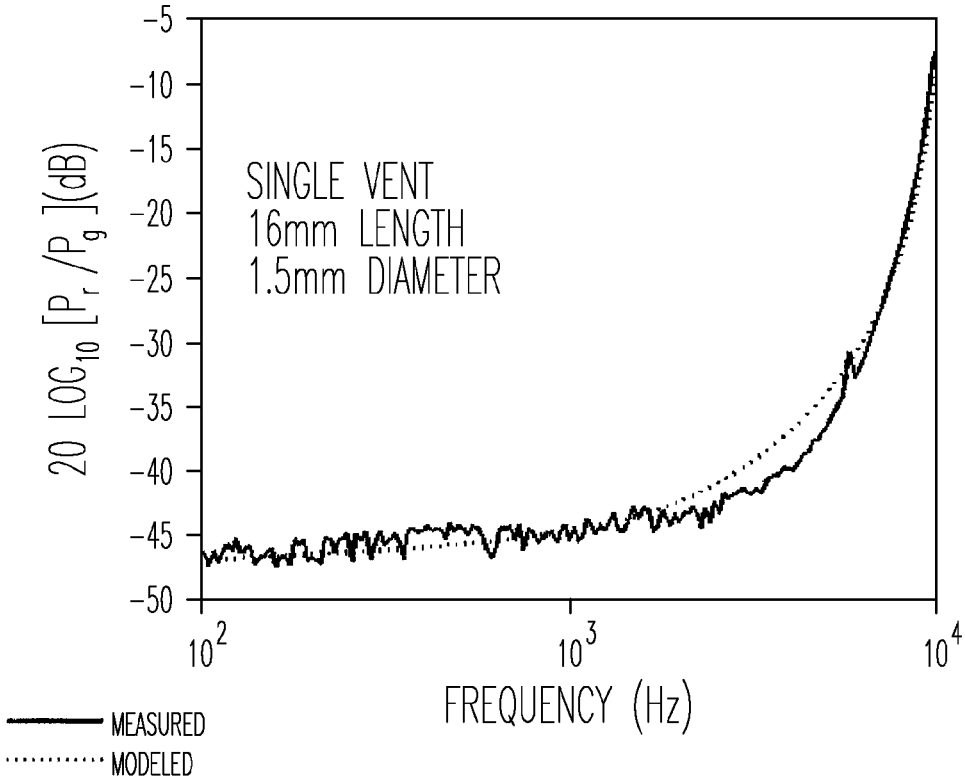
Fig. 1C (Prior Art)
FIG. 1C compares measured results to modeled results for the device shown in FIG. 1A.

FIG. 1A shows a side cross-sectional view of an in-the-ear (ITE) hearing assistance device 101 according to the prior art. Device 101 includes a faceplate 100 which includes a vent 120 functioning as an acoustical passage that connects the outside air medium to the interior ear canal 102 with residual air volume 103. Faceplate 100 also includes acoustical inlet 112 for microphone 114, which is connected to electronics 116 and receiver 118, which functions as a loudspeaker or earphone that generates acoustic pressure waves within the residual ear canal air volume 103. The pressure waves propagate through the vent 120 and radiate out into the air medium. Using an acoustical impedance equivalent circuit analog as shown in FIG. 1B in which pressure is the potential quantity and volume velocity is the flux quantity, the vent 120 behaves as an inertance and is modeled as an inductor M whose value is directly proportional to the product of the ambient air density and the length of the vent, and inversely proportional to the surface area of the vent. Using the same analog, the exterior air medium behaves primarily as a radiation resistance and is modeled as a resistor R whose value is directly proportional to the product of the ambient air density and the square of the radial frequency, and inversely proportional to the product of a constant and the speed of sound. The constant depends upon the exterior vent's boundary conditions and is typically set at $2\pi$ or $4\pi$, depending on a half- or full-space steridian field. The acoustical feedback venting gain (AFVG) can be computed from the equivalent circuit analog using standard voltage division techniques. Assuming receiver 118 is driven to produce a frequency-independent constant pressure $P_g$ of 1 Pascal at acoustical outlet 122, the AFVG is simply the potential $P_r$ across resistor R and is show in FIG. 1C together with the measured data for a cylindrical vent of 16 mm length and 1.5 mm diameter. The data show how the venting configuration of device 101 attenuates low and mid frequency acoustic energy effectively while allowing high frequency acoustic energy to radiate outward much more easily. It should be noted that the peak at approximately 10 kHz in the AFVG is due solely to longitudinal standing waves in vent 120. It should also be noted that an acoustical transmission line equivalent analog could be used to model the AFVG.

Figure 2A:
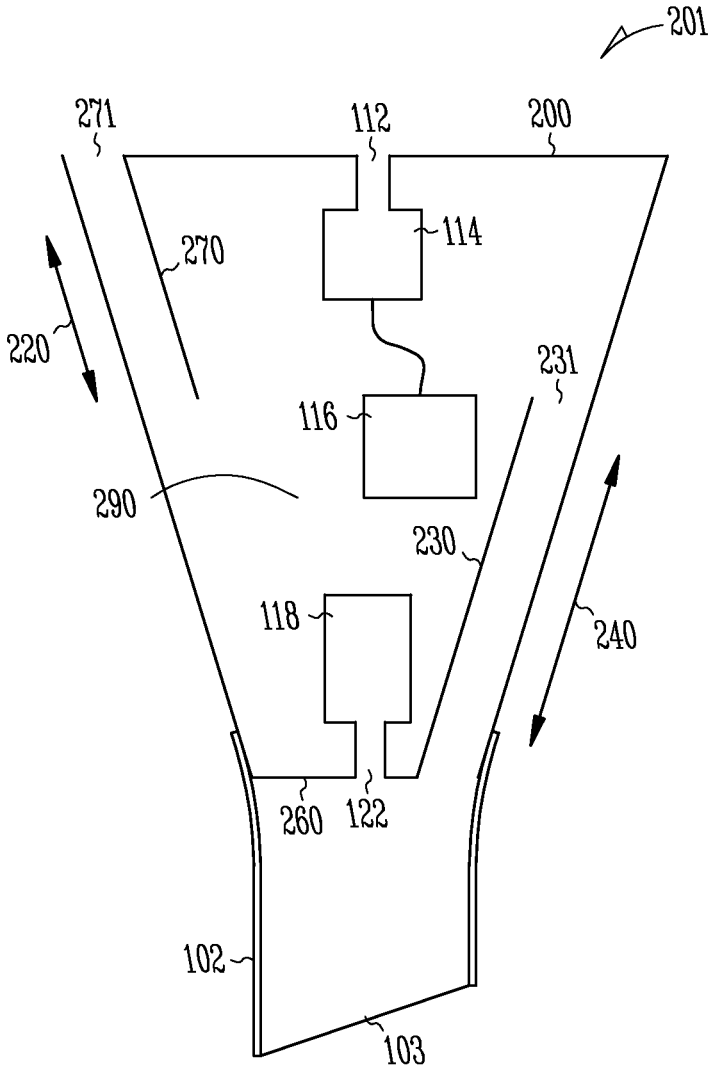
FIG. 2A shows a side cross-sectional view of an in-the-ear hearing assistance device according to one embodiment of the present subject matter.

FIG. 2A shows a side cross-sectional view of an ITE hearing assistance device 201 according to one embodiment of the present subject matter.

The ITE device 201 of FIG. 2A includes a faceplate 200 and an interior end 260. The interior end 260 of device 201 includes a first vent 230 having an acoustical passage 231 of length 240 that connects the earmold's internal air volume 290 to ear canal 102 having its own residual air volume 103. The acoustical passage 231 of the first vent 230 is elongate, in an embodiment. Ear canal 102 will differ in shape and size from person to person, so ITE 201 can be custom fitted to the user's ear to provide a comfortable fit and reduce air gaps between the device and the ear canal. The faceplate 200 of ITE device 201 includes an acoustical inlet 112 for microphone 114 and a second vent 270 having an acoustical passage 271 of length 220 which connects the exterior air medium to the earmold's internal air volume 290. The acoustical passage 271 of the second vent 270 is elongate, in an embodiment. In various embodiments, the internal air volume 290 envelopes microphone 114, electronics 116, and receiver 118. With this approach, sound waves are detected by microphone 114 via acoustical inlet 112; an analogous electrical signal is sent to electronics 116, processed, amplified, and delivered to receiver 118. Receiver 118 is adapted to transmit sound waves to the ear of a user through acoustical outlet 122. It is understood that the electronics 116 may include known and novel signal processing electronics configurations and combinations for use in hearing assistance devices. Different electronics 116 may be employed without departing from the scope of the present subject matter. Such electronics may include, but are not limited to, combinations of components such as amplifiers, multi-band compressors, noise reduction, acoustic feedback reduction, telecoil, radio frequency communications, power, power conservation, memory, and various forms of digital and analog signal processing electronics.

The configurations, lengths, and air volumes of device 201 are selected to reduce the acoustical feedback gain (AFG) at high frequencies. The AFG differs from the AFVG in that the propagation path from the second vent 271 to the microphone inlet 112 is included in the AFG. The AFG is defined as the ratio of the sound pressure level detected by microphone 114 at acoustical inlet 112 to the sound pressure level produced by receiver 118 at acoustical outlet 122.

Figure 2B:
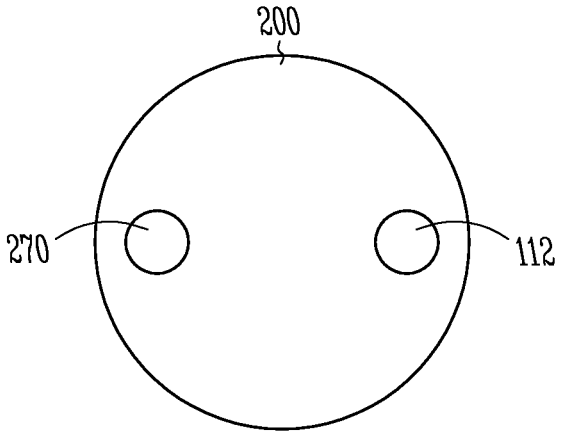
FIG. 2B shows a view of the faceplate of the hearing assistance device of FIG. 2A according to one embodiment of the present subject matter.
Figure 4A:
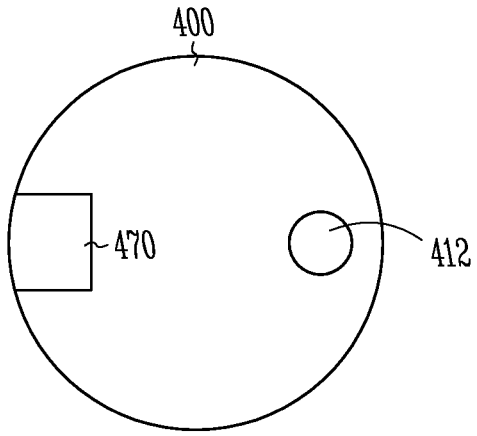
FIG. 4A shows one embodiment of a faceplate of a hearing assistance device with a noncircular vent shape to demonstrate that vent shapes may vary without departing from the scope of the present subject matter.

FIG. 2B shows the layout of a faceplate 200 demonstrating one example for placement of acoustical inlet 112 and the second vent 270 having surface area $S_2$. It is understood that other shapes of acoustical inlet 112 and surface areas $S_2$ of the second vent 270 may be employed without departing from the scope of the present subject matter. Some such examples are shown in FIG. 4A. It is also understood that the placement of acoustical inlet 112 relative to the second vent 270 may vary without departing from the scope of the present subject matter. To reduce the acoustical feedback gain, it may be advantageous to separate them as far as possible to reduce acoustic coupling between the microphone acoustical inlet 112 and the second vent 270.

Figure 2C:
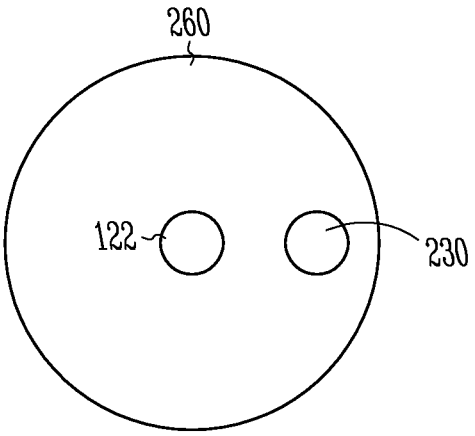
FIG. 2C shows the interior end of the hearing assistance device of FIG. 2A according to one embodiment of the present subject matter.
Figure 4B:
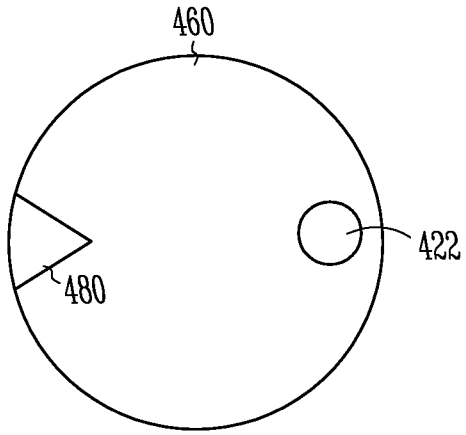
FIG. 4B shows one embodiment of an interior end of a hearing assistance device with a noncircular vent shape to demonstrate that vent shapes may vary without departing from the scope of the present subject matter.

FIG. 2C depicts a view of the interior (ear canal) end 260 of the hearing assistance device of FIG. 2A according to one embodiment of the present subject matter. A receiver can deliver sound via acoustical outlet 122 to the ear canal of a user. The first vent 230 having surface area $S_1$ connects the device's internal air volume with the residual air volume 103 of the user's ear canal. It is understood that other shapes of acoustical outlet 122 and surface area $S_1$ of the first vent 230 may be employed without departing from the scope of the present subject matter. Some such examples are shown in FIG. 4B. It is also understood that the relative placement of acoustical outlet 122 to the first vent 230 may vary without departing from the scope of the present subject matter. It may be advantageous to reduce AFG by separating them as far as possible to reduce acoustic coupling between the receiver acoustical outlet 122 and the first vent 230.

Figure 7:
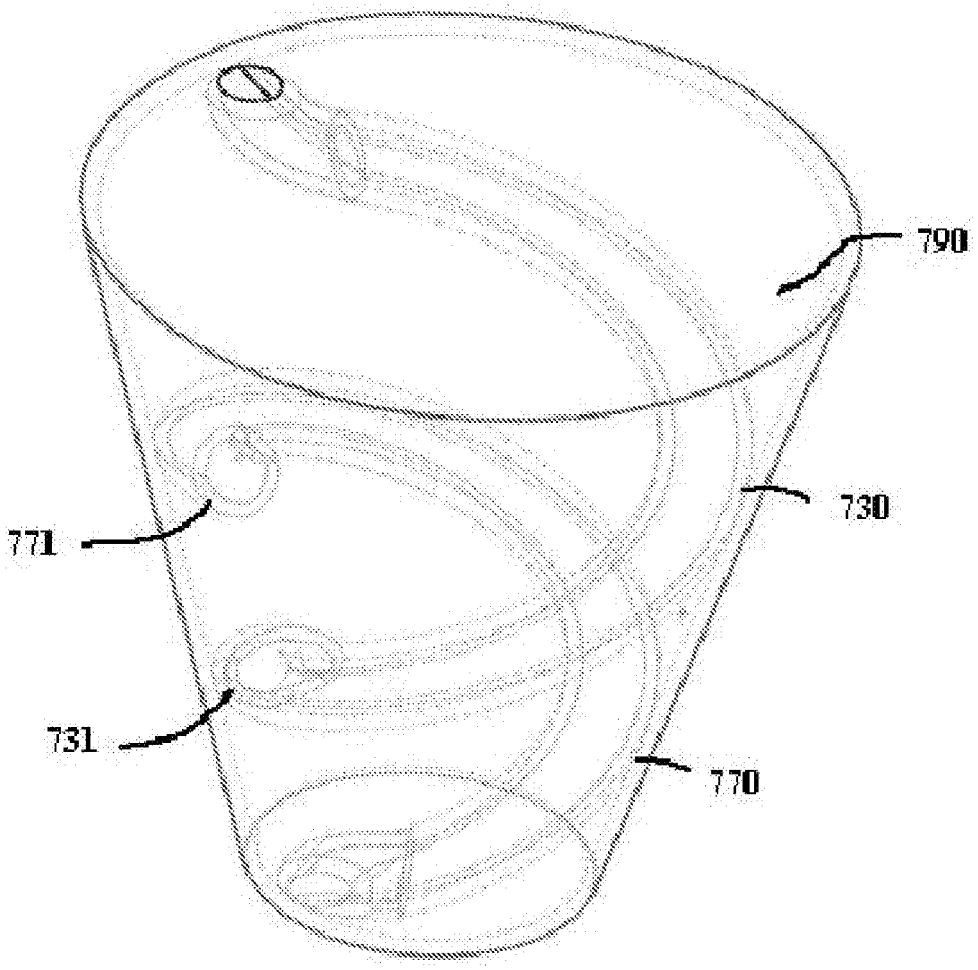
FIG. 7 shows an embodiment with curved dual vents.

The dual vents are not in geometric alignment, or off-axis, in an embodiment. In some embodiments, the dual vents are realized as straight vents with a constant cross sectional area. In some embodiments, the dual vents are realized as twisted or curved as required by the internal geometry and position of transducers. In one embodiment, the first vent is adjacent to the second vent. In varying embodiments, the two vents are fashioned in a swirling pattern about each other. FIG. 7 shows an embodiment in which the internal air volume 790 is connected to a first vent 730 via opening 731 and connected a second vent 770 via opening 771.

It is understood that the first vent 230 and the second vent 270 shown in FIG. 2A are not necessarily drawn to scale. Furthermore, it is understood that the vent geometries may be varied to achieve desired effects and not depart from the scope of the present subject matter. Some examples include, but are not limited to, the vents being adapted to have varying widths, structure, curvature, and relative placement without departing from the scope of the present subject matter. Similarly, a variable vent could be inserted into either of the two vents to achieve the desired filtering effect. These plugs, typically used by dispensers and sometimes referred to as "vari-vents" could be chosen and inserted during a patient's fitting session so as to allow custom venting. It is also understood that the internal electronics 116, microphone 114, and receiver 118 are not intended to necessarily be drawn to scale.

Figure 2D:
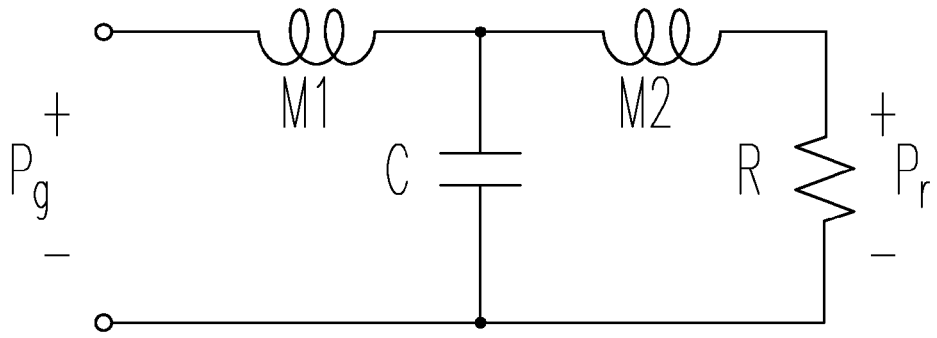
FIG. 2D shows an acoustical impedance lumped element equivalent circuit analog for the device shown in FIG. 2A.
Figure 2E:
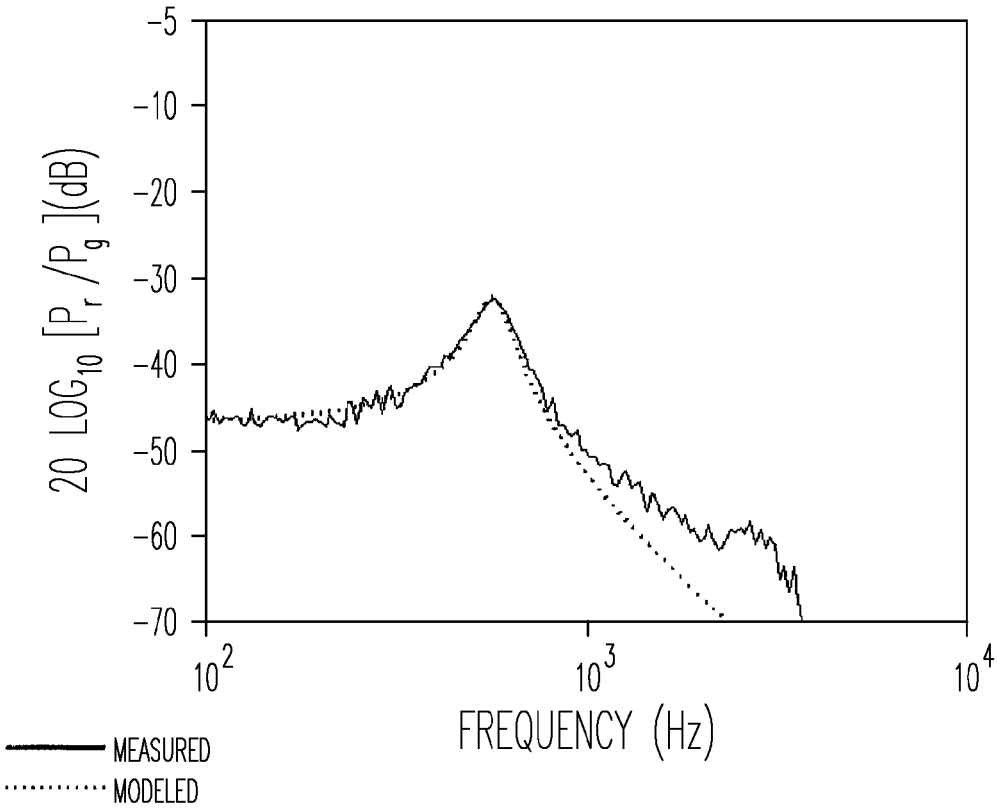
FIG. 2E compares measured results to modeled results for the device shown in FIG. 2A.

During normal operation of ITE device 201, the pressure waves from receiver 118 within residual air volume 103 propagate through the first vent 230, radiate into internal air volume 290, propagate through the second vent 270, and radiate out into the air medium. Using an acoustical impedance equivalent circuit analog as shown in FIG. 2D in which pressure is the potential quantity and volume velocity is the flux quantity, the first vent 230 and the second vent 270 behave as inertances that are modeled as inductors M1 and M2, respectively, whose values are directly proportional to the product of the ambient air density and the length of the vent, and inversely proportional to the surface area of the vent. The internal air volume 290 behaves as an acoustical capacitance C whose approximate value is directly proportional to the air volume and inversely proportional to the product of the air medium's ambient density and its speed of sound squared. Using the same analog, the exterior air medium behaves primarily as a radiation resistance and is modeled as a resistor R whose value is directly proportional to the product of the ambient air density and the square of the radial frequency, and inversely proportional to the product of a constant and the speed of sound. The constant depends upon the boundary conditions of the second vent 270 and is typically set, for convenience, to $2\pi$ or $4\pi$, depending on a half- or full-space approximated steridian freefield. The acoustical feedback venting gain (AFVG) can be computed from the equivalent circuit analog using standard voltage division techniques. Assuming receiver 118 is driven to produce a frequency-independent constant pressure $P_g$ of 1 Pascal at acoustical outlet 122, the AFVG is simply the potential across resistor R and is shown in FIG. 2E together with the measured data for a first cylindrical vent of 12 mm length, 1 mm diameter, an internal air volume 290 of 0.7 cc, and a second cylindrical vent of 6 mm length, 1 mm diameter. The data show how the venting configuration of device 201 allows acoustic energy in the 550 Hz region to pass more efficiently than a the single vent ITE device 101 while dramatically attenuating acoustic energy above 1 kHz. It should be noted that the peak at approximately 550 Hz in the AFVG is due to the judicious choice of internal air volume, vent lengths. It should also be noted that an acoustical transmission line equivalent analog could be used to model the AFVG of ITE device 201.

It is understood that FIG. 2A is intended to demonstrate one application of the present subject matter and that other applications are provided. FIG. 2A relates to the use of the present dual vent design in an ITE (in-the-ear) hearing assistance device. However, it is understood that the dual vent design of the present subject matter may be used in other devices and applications. One example is the earmold of a BTE (behind-the-ear) hearing assistance device, as demonstrated by FIG. 3A. Other hearing assistance devices may employ the present dual vent design without departing from the scope of the present subject matter.

Figure 3A:
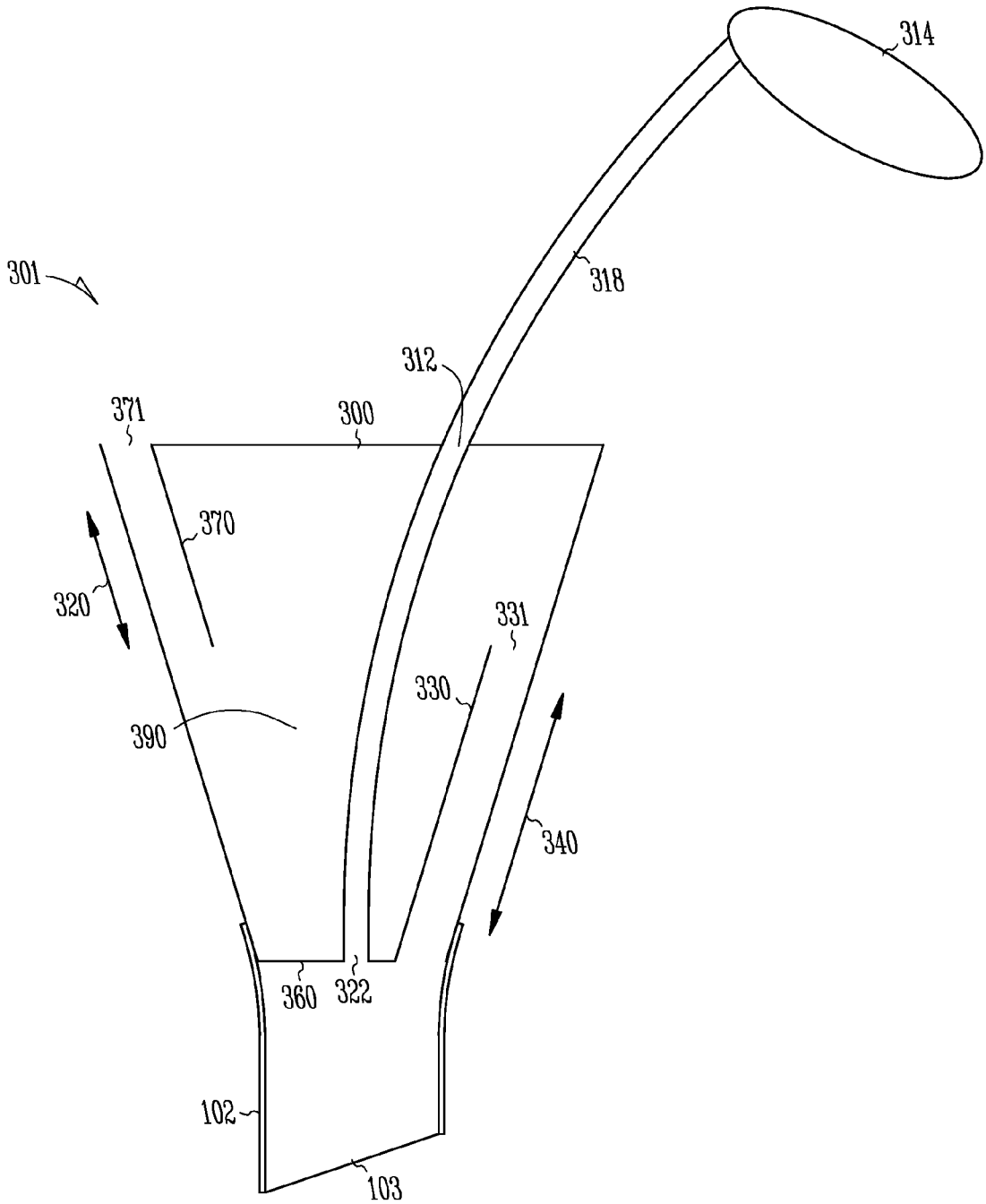
FIG. 3A shows a side cross-sectional view of a custom or standard earmold for a behind-the-ear hearing assistance device according to one embodiment of the present subject matter.

The embodiment of FIG. 3A provides a way to transmit sound to the interior end 360 of an earmold device 301 using a BTE (behind-the-ear) hearing assistance device 314. The BTE 314 delivers sound through sound tube 318 and hole 322 to the residual ear canal air volume 103 at the interior end of earmold device 301. The remaining operation of the device is largely the same as set forth for FIG. 2A, except that the BTE 314 includes the microphone and electronics and the earmold 301 contains the sound tube 318. The faceplate 300 of device 301 includes a hole 312 for sound tube 318 and a second vent 370 having an acoustical passage 371 of length 320 which connects the exterior air medium to the earmold's internal air volume 390. The interior end 360 of device 301 includes a first vent 330 having an acoustical passage 331 of length 340 that connects the earmold's internal air volume 390 to ear canal 302 the residual air volume 103. According to various embodiments, the acoustical passage 331 of the first vent 330 and the acoustical passage 371 of the second vent 370 are elongate. The first and second vents are not in geometric alignment, or off-axis, in an embodiment.

Figure 3B:
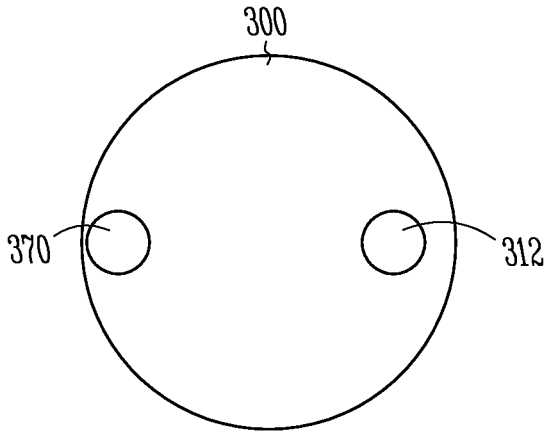
FIG. 3B shows a view of the faceplate of the hearing assistance device of FIG. 3A according to one embodiment of the present subject matter.

FIG. 3B shows the layout of a faceplate 300 demonstrating one example for placement of acoustical inlet 312 and the second vent 370 having surface area $S_2$. It is understood that other shapes of acoustical inlet 312 and surface areas $S_2$ of the second vent 370 may be employed without departing from the scope of the present subject matter. Some such examples are shown in FIG. 4A. It is also understood that the placement of acoustical inlet 312 relative to the second vent 370 may vary without departing from the scope of the present subject matter. To reduce the acoustical feedback gain, it may be advantageous to separate them as far as possible to reduce acoustic coupling between the microphone acoustical inlet 312 and the second vent 370.

Figure 3C:
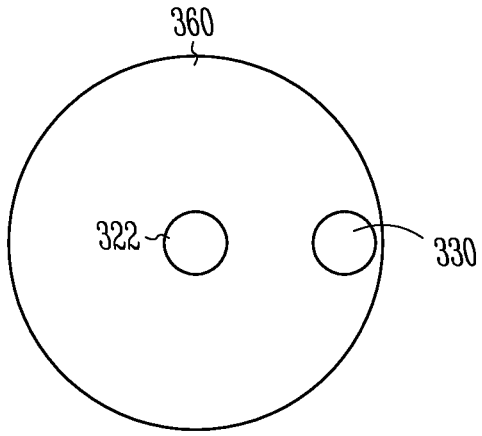
FIG. 3C shows the interior end of the hearing assistance device of FIG. 3A according to one embodiment of the present subject matter.

FIG. 3C depicts a view of the interior (ear canal) end 360 of the hearing assistance device of FIG. 3A according to one embodiment of the present subject matter. A receiver can deliver sound via acoustical outlet 322 to the ear canal of a user. The first vent 330 having surface area $S_1$ connects the device's internal air volume with the residual air volume of the user's ear canal. It is understood that other shapes of acoustical outlet 322 and surface area $S_1$ of the first vent 330 may be employed without departing from the scope of the present subject matter.

FIG. 4A shows the layout of a faceplate 400 demonstrating one example for placement of an acoustical inlet 412 and a noncircular second vent 470. FIG. 4B shows the layout of the interior (ear canal) end 460 demonstrating one example for placement of an acoustical outlet 422 and a noncircular first vent 480.

Figure 5:
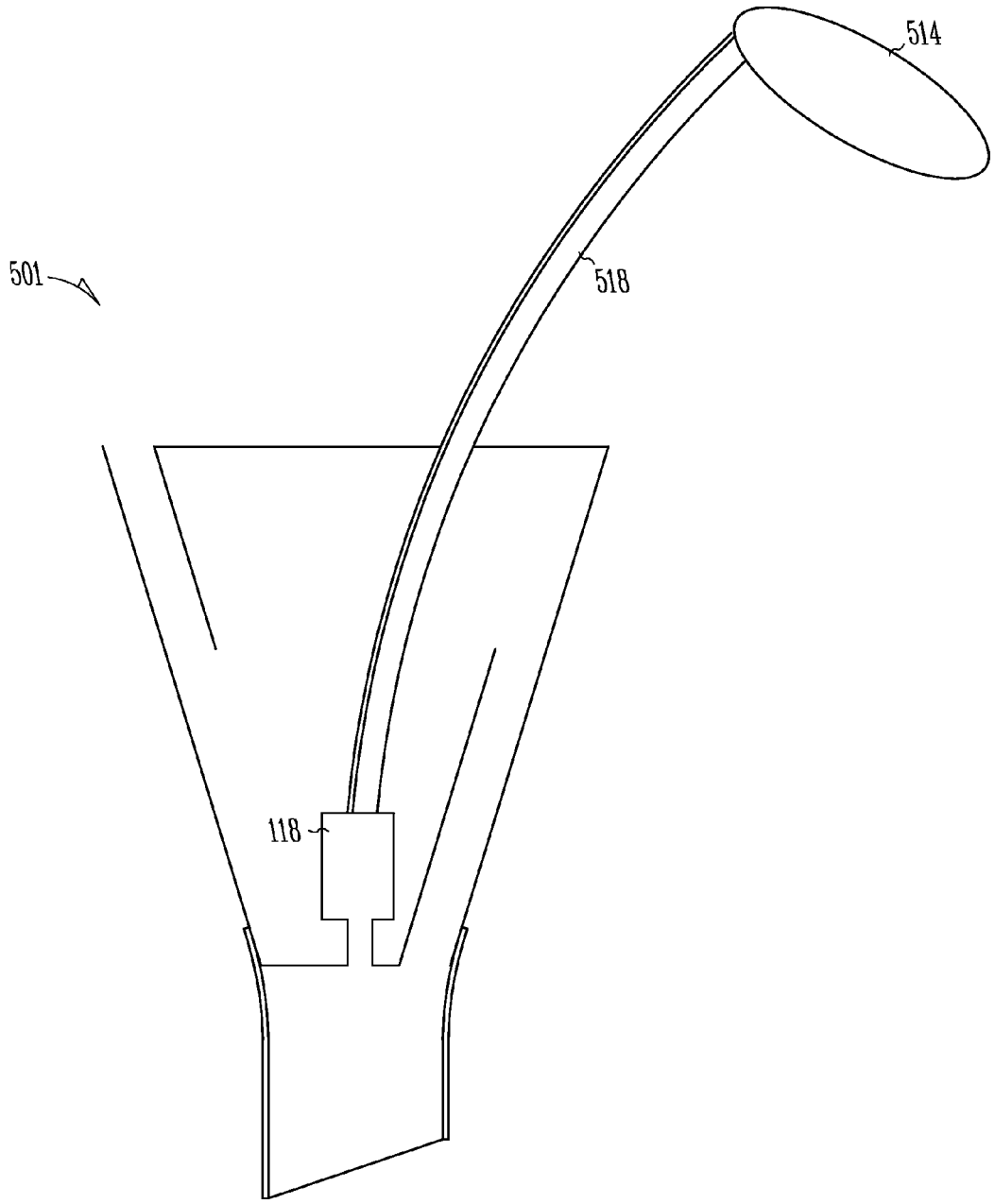
FIG. 5 demonstrates one example of a behind-the-ear hearing assistance device in wired electrical communications with a dual vented earmold having a receiver according to one embodiment of the present subject matter.

Other embodiments are possible without departing from the scope of the present subject matter. For instance, in one embodiment, such as the one demonstrated by FIG. 5, a BTE 514 provides an electronic signal to an earmold having a receiver 118. This variation includes a wired connection 518 for providing the acoustic signals to the earmold 501.

Figure 6:
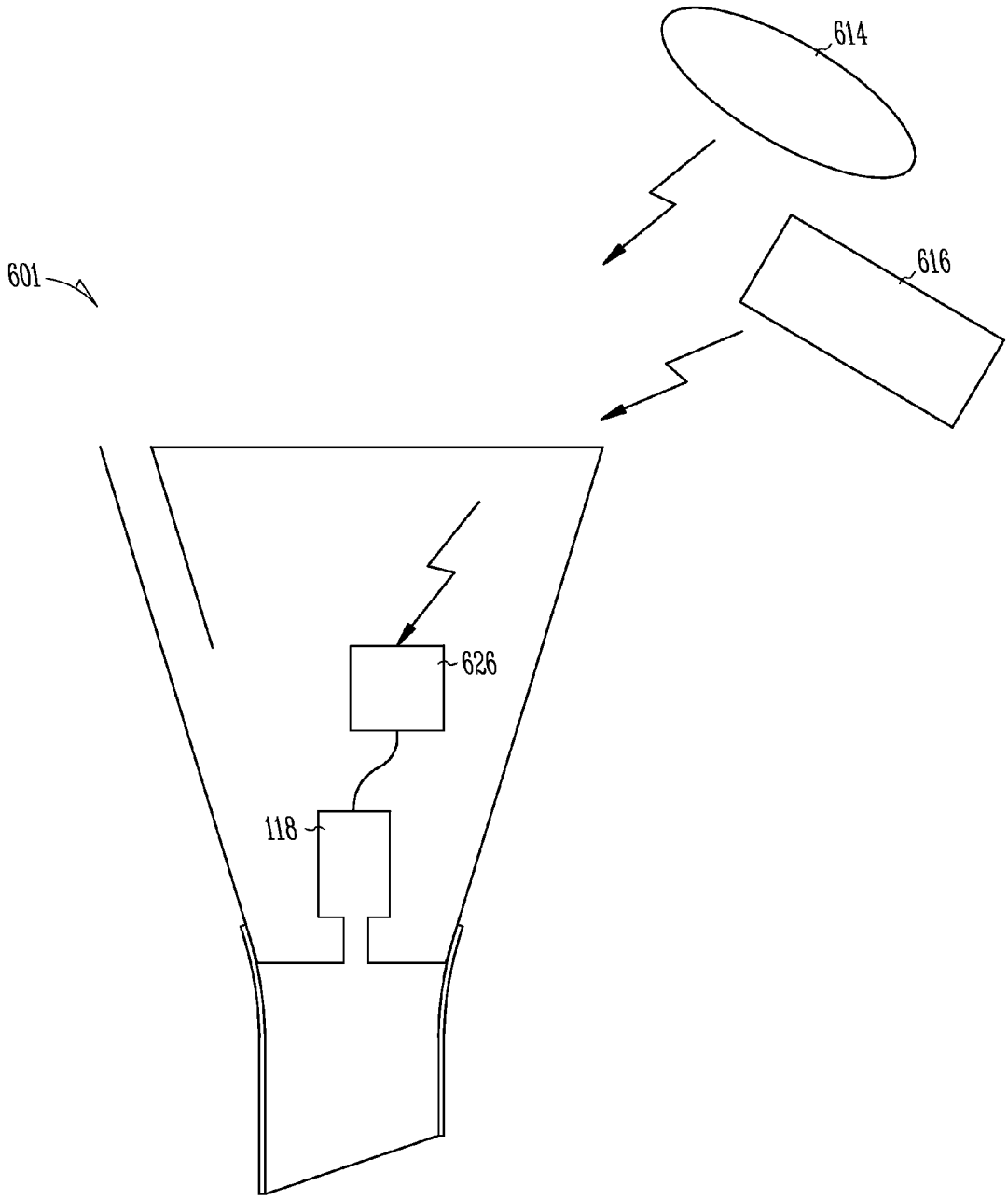
FIG. 6 demonstrates one example of a behind-the-ear hearing assistance device in wireless electrical communications with a dual vented earmold having a receiver according to one embodiment of the present subject matter.

In one embodiment, such as the one demonstrated in FIG. 6, a wireless approach is employed, such that the earmold 601 includes a wireless electronics for receiving sound from a BTE 614 or other signal source 616 having a wireless communications module. Such wireless communications are possible by fitting the earmold with wireless electronics 626, receiver electronics 118 and a power supply. In bidirectional applications, it may be advantageous to fit the earmold with a microphone to receive sound using the earmold. In various applications, the BTE 614 includes a microphone. In various applications the signal source 616 includes a microphone. It is understood that many variations are possible without departing from the present subject matter.

It is understood that a custom earmold may be employed in various embodiments. It is understood that a standard earmold may be employed in various embodiments.

Several approaches to determining the dimensions of the earmold and vents are possible. Some typical limits on the values can be determined. The length $L_2$ of the second vent can vary from the thickness of the faceplate at its thinnest region to about 4 centimeters. The surface area of the second vent can vary from about 0.0003 cm squared to about 0.30 cm squared. It is noted that the surface area may vary along the length of the second vent. The length $L_1$ of the first vent can vary from the thinnest portion of the shell at the interior (ear canal) side to about 4 cm. The surface area of the first vent can vary from about 0.0003 cm squared to about 0.30 cm squared. It is noted that the surface area may vary along the length of the ear canal vent. The internal volume of the shell can vary from about 0.1 cubic centimeters to about 5 cubic centimeters.

The vents of the present subject matter can be formed using methods including, but not limited to, drilling, computer aided manufacturing, stereo lithography, and any other form of three dimensional manufacturing. In an embodiment, the device of the present subject matter (such as 201 in FIG. 2A) is formed using a stereo lithography apparatus (SLA). Forming the device using an SLA includes creating a three dimensional model of the device using a computer assisted drawing (CAD) program, in an embodiment. A software program is used to "slice" the CAD model into thin layers, such as five to ten layers per millimeter, in an embodiment. The SLA uses a specialized three-dimensional printer with a laser that forms one of the layers, exposing liquid plastic in the SLA's tank and hardening it. A moving platform within the tank drops down a fraction of a millimeter and the laser forms the next layer, in an embodiment. This process repeats, layer by layer, until the device is completely formed.

In various embodiments, the vents are constructed in a way which utilizes the internal air volume of the device. Examples include, but are not limited to those provided in FIGS. 1A, 2A, 3A, 5, and 6. It is understood that other embodiments employing vents outside of this internal volume are possible without departing from the scope of the present subject matter.

Although specific embodiments have been illustrated and described herein, other embodiments are possible without departing from the scope of the present subject matter.

What is claimed is:

1. An apparatus for an ear having an ear canal, the ear canal having a residual ear canal volume after the apparatus is placed in the canal, the apparatus comprising:

an earmold having a shell with sidewalls adapted to at least partially fit within the ear canal, the earmold including an internal air volume;

a first vent with an elongated acoustical passage connecting the internal air volume of the earmold to the residual ear canal air volume;

a second vent with an elongated acoustical passage connecting the internal air volume of the earmold to air external to the ear;

wherein the first vent has a first internal opening adjacent to the internal air volume and a first external opening adjacent to the residual ear canal air volume;

wherein the second vent has a second internal opening adjacent to the internal air volume and a second external opening adjacent to the residual ear canal air volume;

wherein the first and second internal openings are located at opposite ends of a line that intersects a longitudinal axis of the earmold running from the residual ear canal volume to the air external to the ear; and wherein the earmold contains a microphone, an amplifier, and a receiver.

2. The apparatus of claim 1, further comprising a sound tube in acoustical communication with the second vent.

3. The apparatus of claim 2, further comprising a behind-the-ear hearing assistance housing connected to the sound tube.

4. The apparatus of claim 1, wherein the receiver further comprises wireless electronics.

5. The apparatus of claim 4, further comprising a wireless communications module in a housing adapted for wireless communications with the wireless electronics.

6. The apparatus of claim 5, wherein the housing is a behind-the-ear housing.

7. The apparatus of claim 4, further comprises a housing wired to the receiver.

8. The apparatus of claim 7, wherein the housing is a behind-the-ear housing.

9. The apparatus of claim 1, wherein the first vent is formed through a faceplate.

10. The apparatus of claim 1, wherein the apparatus is an in-the-ear housing.

11. The apparatus of claim 1, wherein the apparatus is a completely-in-the-canal housing.

12. A method of forming an apparatus for an ear having an ear canal, the ear canal having a residual ear canal volume after the apparatus is placed in the canal, the method comprising:

forming an earmold having a shell with sidewalls adapted to at least partially fit within the ear canal, the earmold including an internal air volume;

disposing a microphone, an amplifier, and a receiver within the earmold;

forming a first vent with an elongated acoustical passage connecting the internal air volume of the earmold to the residual ear canal air volume;

forming a second vent with an elongated acoustical passage connecting the internal air volume of the earmold to air external to the ear;

wherein the first vent has a first internal opening adjacent to the internal air volume and a first external opening adjacent to the residual ear canal air volume;

wherein the second vent has a second internal opening adjacent to the internal air volume and a second external opening adjacent to the residual ear canal air volume; and, wherein the first and second internal openings are located at opposite ends of a line that intersects a longitudinal axis of the earmold running from the residual ear canal volume to the air external to the ear.

13. The method of claim 12, wherein forming the apparatus includes using computer aided manufacturing.

14. The method of claim 13, wherein the computer aided manufacturing includes stereo lithography.

15. The method of claim 12, wherein forming the first vent includes forming a substantially cylindrical vent.

16. The method of claim 12, wherein forming the second vent includes forming a substantially cylindrical vent.

17. The method of claim 12, wherein the line intersecting the longitudinal axis of the earmold is perpendicular to the longitudinal axis.

18. The method of claim 12, wherein the first and second vents are located on the sidewalls of the earmold on opposite sides of a plane defined by the longitudinal axis of the earmold and a line intersecting therewith.

19. The method of claim 12, wherein forming the first vent includes forming the vent with a length less than 4 centimeters.

20. The method of claim 12, wherein forming the second vent includes forming the vent with a length less than 4 centimeters.

21. The method of claim 12, wherein forming the first vent includes forming the vent having a cross-sectional surface area of between about 0.0003 to about 0.30 centimeters squared.

22. The method of claim 12, wherein forming the second vent includes forming the vent having a cross-sectional surface area of about 0.0003 to about 0.30 centimeters squared.

23. The apparatus of claim 1 wherein the first and second vents are constructed to attenuate acoustic energy at frequencies above 1 kHz.

24. The method of claim 12 wherein the first and second vents are constructed to attenuate acoustic energy at frequencies above 1 kHz.

* * * * *